US005958277A

United States Patent [19]

Lee

[11] Patent Number: 5,958,277

[45] Date of Patent: Sep. 28, 1999

[54] MICROWAVE OVEN HAVING A 2-LEVEL SIMULTANEOUS COOKING FUNCTION AND CONTROL METHOD THEREOF

[75] Inventor: Jung-hee Lee, Suwon, Rep. of Korea

[73] Assignee: Samsung Electronics Co., Ltd., Suwon, Rep. of Korea

[21] Appl. No.: 09/018,053

[22] Filed: Feb. 3, 1998

[30] Foreign Application Priority Data

Nov. 4, 1997 [KR] Rep. of Korea ..... 97-57846

[51] Int. Cl.[6] ..... H05B 6/66

[52] U.S. Cl. ..... 219/702

[58] Field of Search ..... 219/680, 663, 219/702, 754

[56] References Cited

U.S. PATENT DOCUMENTS

| | | | |
|---|---|---|---|
| 4,140,888 | 2/1979 | Baron et al. | 219/702 |
| 4,455,467 | 6/1984 | Dills . | |
| 4,593,171 | 6/1986 | Colato . | |
| 4,713,513 | 12/1987 | Colato . | |
| 5,272,300 | 12/1993 | Edamura et al. | 219/702 |
| 5,609,786 | 3/1997 | An et al. | 219/702 |

FOREIGN PATENT DOCUMENTS

| | | |
|---|---|---|
| 0 366 137 A1 | 5/1990 | European Pat. Off. . |
| 0 454 143 A2 | 10/1991 | European Pat. Off. . |
| WO 97/03323 | 1/1997 | WIPO . |

*Primary Examiner*—Teresa Walberg
*Assistant Examiner*—Jeffrey Pwu
*Attorney, Agent, or Firm*—Burns, Doane, Swecker & Mathis, L.L.P.

[57] ABSTRACT

A microwave oven has a 2-level simultaneous cooking function wherein different foods can be simultaneously cooked at different levels in the cooking chamber. The oven includes a display, and a memory in which a list of menus is stored. Each menu represents a pre-established combination of different foods capable of 2-level simultaneous cooking. A user actuates a menu-selecting key, whereby a different menu is displayed per each actuation of the menu selecting key. By then actuating a cooking-start key, the 2-level cooking conditions associated with the food combination of the currently displayed menu are carried out.

1 Claim, 3 Drawing Sheets

MICROWAVE OVEN HAVING A 2-LEVEL SIMULTANEOUS COOKING FUNCTION AND CONTROL METHOD THEREOF

BACKGROUND OF THE INVENTION

1. Field of the Invention

The present invention relates to a microwave oven, and more particularly to a microwave oven having a 2-level simultaneous cooking function and control method thereof.

2. Description of the Prior Art

A 2-level simultaneous cooking of a microwave oven is a method of cooking two kinds of foods by using a difference of microwaves which are emitted to a bottom and to the center portion in a cooking chamber of the microwave oven, thereby saving a time for cooking the foods by the microwave oven.

Generally, after understanding combinations of menus on a manual provided by a maker, a user places two kinds of foods at respective levels on a tray or a rack in the cooking chamber of the microwave oven. Then, the user carries out cooking the foods by setting cooking conditions such as a cooking time and the like.

In the microwave oven having the 2-level simultaneous cooking function according to the conventional microwave oven, however, since the user must set the cooking conditions by using the manual, there is a disadvantage in that the user has a difficulty in using the microwave oven.

SUMMARY OF THE INVENTION

The present invention has been made to overcome the above described problem of the prior art. It is an object of the present invention to provide a microwave oven having a 2-level simultaneous cooking function and a method of controlling thereof, in which the consumer easily carries out cooking the foods without setting the cooking conditions by using a user manual.

To accomplish the above object of the present invention, there is provided a microwave oven having a 2-level simultaneous cooking function comprising a memory for storing a combination of menus being capable of 2-level simultaneous cooking, and cooking conditions corresponding to the combinations, a key inputting section for including a function selecting key for selecting the 2-level simultaneous cooking function, a menu selecting key for selecting a 2-level simultaneous cooking menu, and a cooking start key, a display for displaying the menus corresponding to the number of inputting of keys of the key inputting section, and a control section for controlling a magnetron by using a power supply and a magnetron driving section according to the cooking conditions which are selected by the key inputting section.

According to the present invention, at least two combinations of the menus and the cooking conditions according to the combinations are stored in the memory. The display displays one of the combinations of the menus in order while the function selection key is pushed.

According to the other aspect of the present invention, there is provided a method of controlling the microwave oven having a 2-level simultaneous cooking function comprising the steps, checking whether the 2-level simultaneous cooking function is selected by a function selection key, counting the number of inputting of the function selection key, displaying the combination of the menus corresponding to the number of inputting of function selection key, checking whether a menu selection key is selected, checking whether cooking start key is inputted, driving a magnetron corresponding to a selected cooking condition, checking whether a cooking time is elapsed, and generating a finishing alarm which informs that the cooking is expired and for stopping the magnetron.

BRIEF DESCRIPTION OF THE DRAWINGS

The above object and other advantages of the present invention will become more apparent by describing in detail the preferred embodiment thereof with reference to the attached drawings, in which.

DESCRIPTION OF THE PREFERRED EMBODIMENT

Hereinafter, a preferred embodiment of the present invention will be described in detail with reference to the accompanying drawings.

Figure 1:
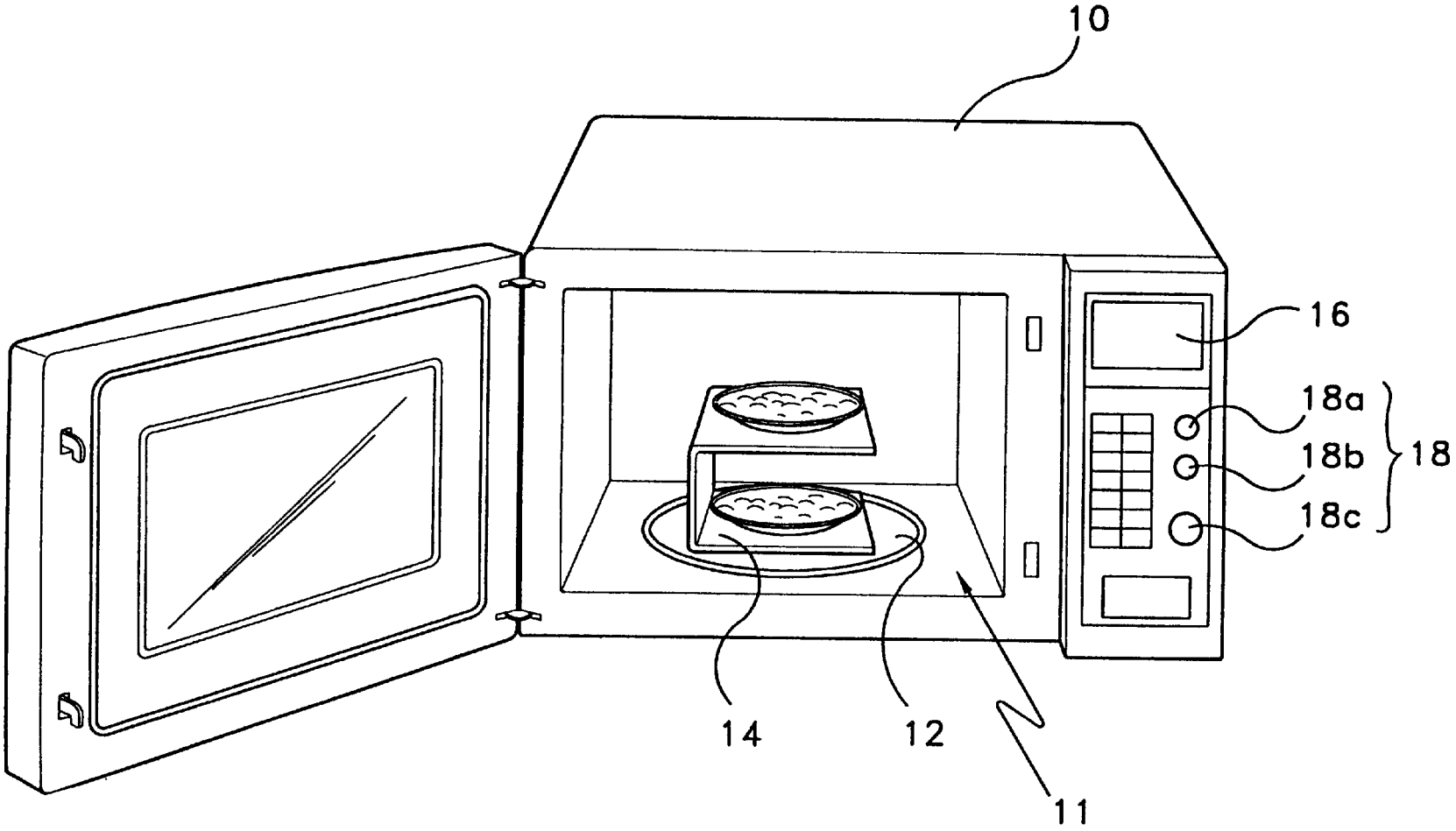
FIG. 1 is a perspective view showing a microwave oven according to the present invention, which has a 2-level simultaneous cooking function.

FIG. 1 is a perspective view of a microwave oven 10 according to the present invention, which has a 2-level simultaneous cooking function. Referring to FIG. 1, microwave oven 10 has a display section 16 and key pads of a key input section 18 on a control panel. Display section 16 includes a liquid crystal display or a fluorescence display. Display section 16 displays a group of menus which can be 2-level simultaneously cooked and a time for cooking. Key input section 18 includes a set of number keys and a set of function keys. The function keys include a function selecting key 18*a* for selecting the 2-level simultaneous cooking function, a menu selecting key 18*b* for selecting a 2-level simultaneous cooking menu, and a cooking start key 18*c*.

Figure 2:
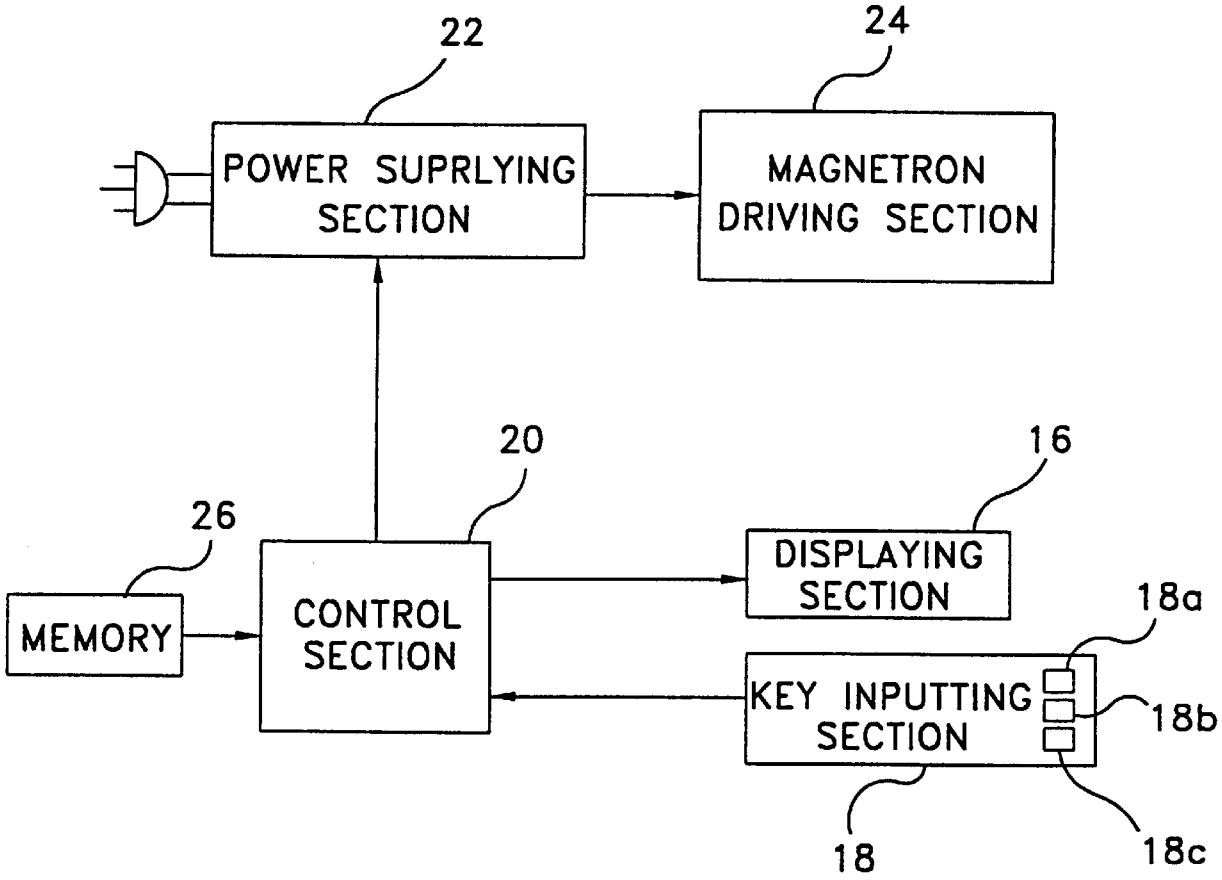
FIG. 2 is a block diagram showing a circuit construction of the microwave oven in FIG. 1.

FIG. 2 is a block diagram showing a circuit of the microwave oven in FIG. 1. Referring to FIG. 2, an alternative current is supplied to a magnetron drive section 24 by an electric power supply 22. Electric power supply 22 supplies the current to magnetron drive section 24 by responding a control signal of a control section 20 so as to control an output of a magnetron. The memory 26 stores a list of menus, and cooking conditions for each menu. Each menu comprises a pre-established combination of foods which consumers prefer and which can be 2-level simultaneously cooked, a list of the menus, and a cooking condition are stored in a memory 26. Some of the menus and the cooking condition thereof are shown on the table 1 for example.

TABLE 1

| | TOP | BOTTOM | TIME | POWER |
|---|---|---|---|---|
| 1 | a Hamburger (7 oz) | a cup of Milk (8 oz) | 1:50 | 100% |
| 2 | a slice of Sliced pan pizza (3.5 oz) | a cup of Milk (8 oz) | 1:30 | 100% |
| 3 | a Sandwich (6 oz) a Hamburger (7 oz) | two cups of Milk (16 oz) | 2:00 | 100% |

Figure 3:
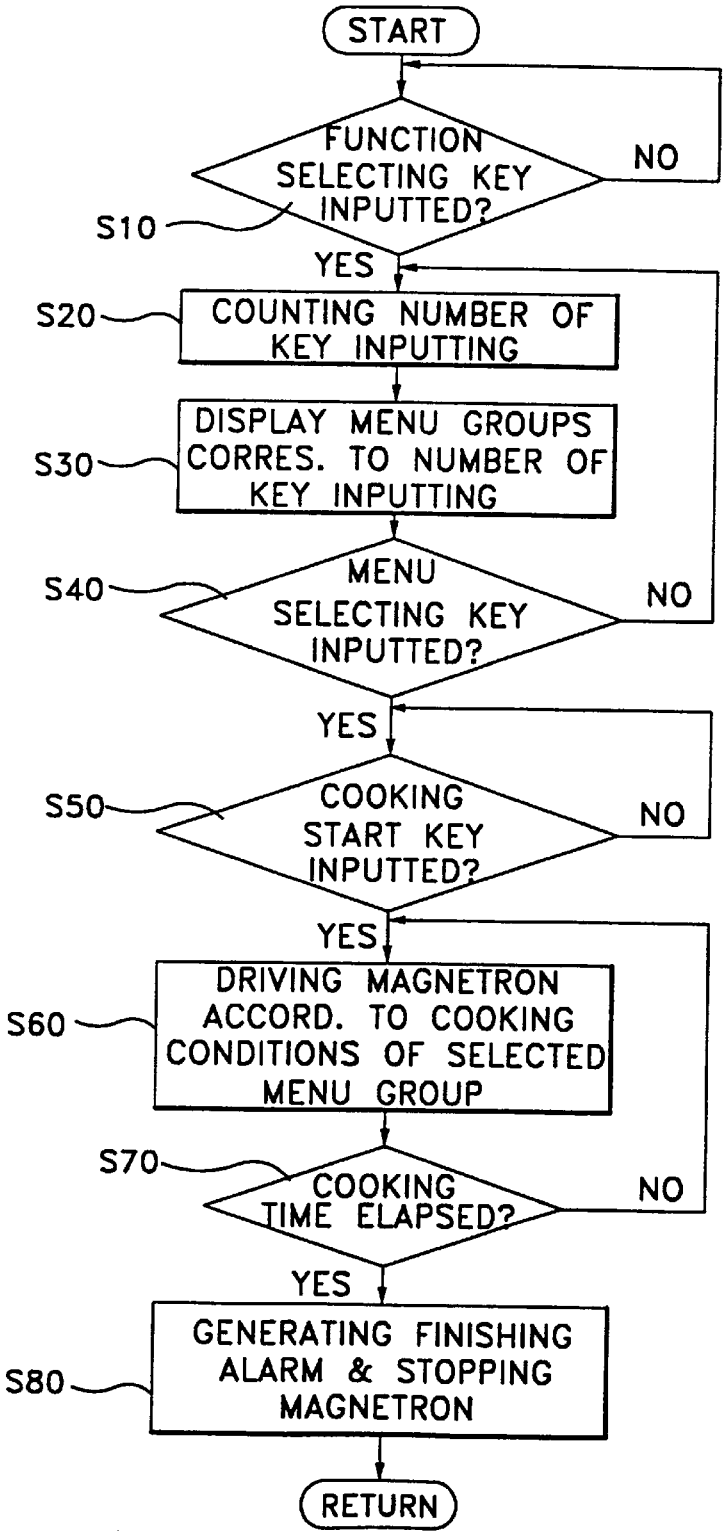
FIG. 3 is a flow chart illustrating a method of controlling the microwave oven in FIG. 1.

FIG. 3 is a flow chart illustrating a method of controlling the microwave oven in FIG. 1 which has the 2-level simultaneous cooking function.

As shown in FIG. 3, the method of controlling the microwave oven according to the present invention comprises a step S10 for checking whether the 2-level simultaneous cooking function is selected by function selection key 18*a,* a step S20 for counting the number of inputting (i.e., the number of actuations) of function selection key 18*a,* a step S30 for displaying the menu corresponding to the number of inputting of function selection key 18*a,* a step S40 for checking whether menu selection key 18*b* is selected, a step S50 for checking whether cooking start key 18*c* is inputted, a step S60 for driving the magnetron corresponding to the selected cooking condition, a step S70 for checking whether a cooking time elapses, and a step S80 for generating a finishing alarm which informs that the cooking is expired and for stopping the magnetron.

In the microwave oven having the 2-level simultaneous cooking function and the method of controlling thereof according to the present invention, when the user selects and inputs the 2-level simultaneous cooking function by using function selection key 18*a* of key inputting section 18, control section 20 checks and counts input signals.

Display section 16 displays the various menus and which information thereof as shown at the table 1 with correspondence the number of times that selection key 18*a* of key input section 18 is inputted. At that time, as the user continues to push selection key 18*a,* the menus and the information thereof which are stored in memory 26 continuously are displayed in order.

When a desire one of the menus is displayed on display section 16, the user selects and inputs the 2-level simultaneous cooking function by pushing selection key 18*b*. Then, the user places a food to be cooked on a turn table 12 in a cooking chamber 11 by using a rack 14 and pushes cooking start key 18*c*.

When the user inputs the condition and time for cooking the food by using the menu selection key 18*b* and pushes cooking start key 18*c,* control section 20 controls power supply section 22 according to the cooking condition so that the magnetron is driven by magnetron drive section 24. After the cooking time is elapsed, control section 20 generates the finishing alarm which informs that the cooking is expired and stops driving of the magnetron.

In the microwave oven and the method of controlling thereof according to the present invention, since the menu of two kinds of foods that can be simultaneously cooked and the cooking conditions thereof are displayed in order by pushing the keys and also are automatically set, the user can easily carry out cooking the foods without setting the cooking conditions by using the user manual.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A method of controlling a microwave oven having a 2-level simultaneous cooking function, the oven comprising a cooking chamber with a plurality of cooking levels, a display, a memory storing menus and 2-level cooking conditions corresponding to each of the menus, each menu comprising a pre-established combination of respective quantities of different foods capable of 2-level simultaneous cooking, and a key inputting section; the method comprising the steps of:

A) selecting the 2-level simultaneous cooking function by actuating a function setting key of the key inputting section;

B) actuating a menu selecting key of the key inputting section for displaying a different menu per each actuation of the menu selecting key;

C) placing the different foods of a presently displayed menu on respective cooking levels; and D) initiating a 2-level simultaneous cooking operation under the cooking conditions corresponding to the presently displayed menu by actuating a cooking start key of the key inputting section.

* * * * *